US009999799B2

(12) United States Patent
Giannelli et al.

(10) Patent No.: US 9,999,799 B2
(45) Date of Patent: Jun. 19, 2018

(54) ARM EXTENSION EXERCISE APPARATUS

(71) Applicant: Cybex International, Inc., Medway, MA (US)

(72) Inventors: Raymond Giannelli, Franklin, MA (US); Mark Buontempo, Millville, MA (US)

(73) Assignee: Cybex International, Inc., Medway, MA (US)

( * ) Notice: Subject to any disclaimer, the term of this patent is extended or adjusted under 35 U.S.C. 154(b) by 0 days. days.

(21) Appl. No.: 14/995,502

(22) Filed: Jan. 14, 2016

(65) Prior Publication Data

US 2016/0136475 A1 May 19, 2016

Related U.S. Application Data

(63) Continuation of application No. PCT/US2015/019855, filed on Mar. 11, 2015.
(Continued)

(51) Int. Cl.
*A63B 21/00* (2006.01)
*A63B 21/005* (2006.01)
(Continued)

(52) U.S. Cl.
CPC ..... *A63B 21/078* (2013.01); *A63B 21/00065* (2013.01); *A63B 21/00076* (2013.01); *A63B 21/0083* (2013.01); *A63B 21/0087* (2013.01); *A63B 21/0407* (2013.01); *A63B 21/062* (2013.01); *A63B 21/063* (2015.10); *A63B 21/0628* (2015.10); *A63B 21/152* (2013.01); *A63B 21/154* (2013.01); *A63B 21/159* (2013.01); *A63B 21/4035* (2015.10); *A63B 21/4047* (2015.10); *A63B 23/0205* (2013.01); *A63B 23/0211* (2013.01); *A63B 23/0233* (2013.01); *A63B 23/035* (2013.01); *A63B 23/03525* (2013.01); *A63B 23/1209* (2013.01);
(Continued)

(58) Field of Classification Search
CPC ..... A63B 21/062–21/0632; A63B 23/1281
See application file for complete search history.

(56) References Cited

U.S. PATENT DOCUMENTS

D490,127 S 5/2004 Giannelli et al.
2002/0052268 A1 5/2002 Morcillo-Quintero et al.
(Continued)

OTHER PUBLICATIONS

Int'l. Search Report and Written OPinion dated May 11, 2015 in Int'l. Appln. PCT/US2015/019855.
(Continued)

*Primary Examiner* — Loan H Thanh
*Assistant Examiner* — Jennifer M Deichl

(57) ABSTRACT

Apparatus for performing an arm extension exercise comprising:
a frame,
a seat having a seating surface (S),
an elbow pad having an engaging surface (ES),
an input arm assembly interconnected to a resistance mechanism and a manually graspable mechanism, the input arm assembly being adapted to reside in a start motionless position (SMP) that disposes the manually graspable mechanism in a start exercise position (SEP) that is disposed vertically above UW) the user's elbows,
the input arm assembly being pivotable around a linear axis disposed rearwardly of the user's elbow.

19 Claims, 9 Drawing Sheets

Related U.S. Application Data

(60) Provisional application No. 61/951,034, filed on Mar. 11, 2014, provisional application No. 61/951,026, filed on Mar. 11, 2014, provisional application No. 61/951,059, filed on Mar. 11, 2014, provisional application No. 61/951,046, filed on Mar. 11, 2014, provisional application No. 61/951,011, filed on Mar. 11, 2014.

(51) Int. Cl.

| | |
|---|---|
| ***A63B 21/008*** | (2006.01) |
| ***A63B 21/012*** | (2006.01) |
| ***A63B 21/02*** | (2006.01) |
| ***A63B 21/04*** | (2006.01) |
| ***A63B 21/055*** | (2006.01) |
| ***A63B 21/062*** | (2006.01) |
| ***A63B 21/078*** | (2006.01) |
| ***A63B 23/02*** | (2006.01) |
| ***A63B 23/035*** | (2006.01) |
| ***A63B 23/12*** | (2006.01) |

(52) U.S. Cl.

CPC ..... *A63B 23/1281* (2013.01); *A63B 21/005* (2013.01); *A63B 21/0088* (2013.01); *A63B 21/012* (2013.01); *A63B 21/023* (2013.01); *A63B 21/0552* (2013.01); *A63B 2208/0228* (2013.01); *A63B 2208/0233* (2013.01); *A63B 2208/0238* (2013.01)

(56) References Cited

U.S. PATENT DOCUMENTS

| | | | | |
|---|---|---|---|---|
| 2002/0198087 | A1* | 12/2002 | Mitchell | A63B 23/1281 482/94 |
| 2003/0171195 | A1* | 9/2003 | Giannelli | A63B 21/00072 482/139 |
| 2007/0238589 | A1 | 10/2007 | Webber | |
| 2010/0019128 | A1 | 1/2010 | Webber et al. | |

OTHER PUBLICATIONS

Communication pursuant to Article 94(3) EPC in European Application 15711999.1-1658.

* cited by examiner

ARM EXTENSION EXERCISE APPARATUS

RELATED APPLICATIONS

This application is a continuation of PCT/US2015/019855, filed Mar. 11, 2015 which claims the benefit of priority to U.S. Provisional Application No. 61/951,011 filed Mar. 11, 2014 and U.S. Provisional Application No. 61/951,059 filed Mar. 11, 2014 and U.S. Provisional Application No. 61/951,026 filed Mar. 11, 2014 and U.S. Provisional Application No. 61/951,034 filed Mar. 11, 2014 and U.S. Provisional Application No. 61/951,046 filed Mar. 11, 2014 the disclosures of all of which are incorporated herein by reference in their entirety as if fully set forth herein.

This application incorporates by reference the disclosures of all of the following in their entirety as if fully set forth herein: U.S. Pat. No. 7,666,123, U.S. Pat. No. 7,717,831, U.S. Pat. No. 4,725,054, U.S. Pat. No. 8,070,658, U.S. Pat. No. 7,278,955, U.S. Pat. No. 8,025,609, U.S. Pat. No. 7,727,128, U.S. Pat. No. D486,535, U.S. Pat. No. D490,127, U.S. Patent Publication No. 2003/0092541, U.S. Patent Publication No. 2007/0173384, U.S. Patent Publication No. 2006/0270531, U.S. Patent Publication No. 2008/0167169, U.S. Patent Publication No. 2010/0204021.

FIELD OF THE INVENTION

The present invention relates to physical exercise machines and more particularly to an exercise apparatus that enables users to perform an arm extension exercise that is resisted by a resistance mechanism.

BACKGROUND OF THE INVENTION

Exercise machines for exercising bicep muscles are known where the user is forced to engage a handle that rotates forcing the user to exert force via wrist and muscles other than the biceps.

SUMMARY OF THE INVENTION

The state of the art in arm extension machines is typically configured as a single joint axis machine where there is either one link with a grip attached where the axis of the arm is coincident with the axis of rotation of the users elbow or two links where the primary link axis is aligned with the users elbow and the secondary link acts as a trailing link to allow for varying forearm lengths. In such configurations, the user has to adjust their position to align their elbow axis with the machine axis or there will be adverse loading at the elbow. In addition, with a single joint axis machine, as the arm travels through the range of motion towards full extension, the applied load at the hand increases the subsequent loading at the shoulder to the extent that the shoulder torque is double of the torque applied to the elbow which is the joint that is being trained. This severely limits the elbow from receiving the correct training load without overloading the shoulder. There are prior art machines that solve this problem by using a trailing link in a primarily horizontal plane with an arm axis that is not coincident with the users elbow. The limitation of that method is it requires the adjustment of two elbow support pads as well as a seat height adjustment to get the user in the correct position based on their physical size and arm position.

The present invention provides an arm extension apparatus that has a trailing link on the end of an arm that is not coincident with the elbow axis and unlike the prior art is primarily in the vertical plane. The benefit to this is there are not adjustments to any support pads or seat to get the user into the proper exercise position. The present invention has the variability to accommodate users of any size and body type without adjustment and the benefit of keeping the adverse torque at the shoulder less than half of what it would be in a single axis machine that is aligned with the elbow axis.

In accordance with the invention there is provided an apparatus (10) for performing an arm extension exercise by a user (5) having a trunk (T1) having a longitudinal axis (LA), opposing anterior (AS) and posterior (PS) sides and arms (13) with elbows (13*e*) extending from the trunk (T1), the apparatus comprising:

a frame (12), a seat (16) having a seating surface (S), an elbow pad (19) having an engaging surface (ES), an input arm assembly (24) interconnected to a resistance mechanism (42) and a manually graspable mechanism (30*h*), the input arm assembly being pivotably mounted (AA) on the frame for back and forth travel along a generally upward (UW) to downward (DW) or forward (FW) to rearward (RW) direction, the input arm assembly (24) being adapted to reside in a start motionless position (SMP) relative to a selected arrangement of the seat (16) and elbow pad (19) that disposes the manually graspable mechanism (30*h*) in a start exercise position (SEP) that is disposed vertically above UW) a point of engagement of a posterior surface (PSE) of the user's elbows (13*e*) with the engaging surface (ES) when the user is seated on the seating surface (S) in an orientation where the anterior surface (AS) of the user's trunk (T1) is facing generally forwardly (FW), the seat (16) and elbow pad (18) being configured and arranged relative to the input arm assembly (24) to position the user in a user start position (USP) that enables the user to manually engage (ME) the manually graspable mechanism (30*h*) when the user is seated in an orientation where a posterior surface (PSE) of the user's elbow (13*e*) is engaged with the engaging surface (ES) of the elbow pad (19) and the anterior and posterior sides of the user's trunk are oriented in a generally forward (FW) to rearward (RW) direction, the input arm assembly comprising a first arm (30*r*) being rotatably pivotable around a first linear axis (AA) starting from the start exercise position (SEP) through a generally rearward to forward or upward to downward path of travel under resistance (R1) exerted by the resistance mechanism on application of forwardly or downwardly directed force (FDF) by the user (5) on the manually graspable mechanism (30*h*), the input arm assembly comprising a second arm (30*f*) rotatably pivotable around a second linear axis (AAA) along a generally rearward to forward or upward to downward path of travel on application of forwardly or downwardly directed force (FDF) by the user (5) on the manually graspable mechanism (30*h*).

The seat (16), elbow pad (19) and arm assembly (24) are preferably arranged on the apparatus such that the first linear axis (AA) of pivoting of the arms (30*f*, 30*r*) is disposed rearwardly (RW) of the user's elbow (13*e*) when the user is seated on the seating surface (S) and the posterior surface (PSE) of the user's elbow (13*e*) is engaged with the engaging surface (ES).

The second arm (30*f*) is preferably pivotable together with the first arm 30*r* around the first linear axis (AA) under resistance (R1, R1*a*) exerted by the resistance mechanism on application of generally forwardly downwardly force (FDF)

by the user on the manually graspable mechanism (30*h*) starting from the start exercise position (SEP).

The manually graspable mechanism can comprise a handle link (30*l*) pivotably mounted to the second arm (30*f*) for separate rotation around a handle axis (Y).

The input arm assembly (24) is typically interconnected to the resistance mechanism (42) at a point of interconnection (30*de*) of the input arm assembly that is spaced a selected orthogonal distance (FOD) apart from the first linear axis (AA) selected to create a first selected torque resistance from the resistance mechanism against rearward (RW) to forward (FW) movement of the input arm assembly.

The input arm assembly (24) is preferably interconnected to the resistance mechanism (42) at a point of interconnection (30*de*) of the input arm assembly that is disposed rearwardly (RW) of the user's elbow (13*e*) when the user is seated on the seating surface (S) and the posterior surface (PSE) of the user's elbow (13*e*) is engaged with the engaging surface (ES).

The first linear axis (AA) and second linear axis (AAA) are typically disposed generally parallel relative to each other.

The first linear axis (AA) and the third linear axis are typically disposed generally parallel to each other.

The first linear axis (AA) is preferably arranged at an angle (X) relative to horizontal (H) that is selected to direct the first arm (30*r*) to travel along a side to side (SS) or lateral path of travel laterally away from (LATO) a midline (M) of the user when the user exerts forwardly or downwardly (FDF) force on the first arm (30*r*) beginning from the start motionless position (SMP) and the user (5) is seated on the seat surface (S) with the user's anterior (AS) surface facing forwardly (FW).

In another aspect of the invention there is provided a method of performing an arm extension exercise comprising:

a user being seated on the seat of the exercise apparatus described above in a disposition where the user is seated on the seating surface, the anterior and posterior sides of the user's trunk are oriented generally in the forward to rearward direction, and the posterior surface of the user's elbow (PSE) is engaged with the engaging surface (ES) of the elbow pad (19), the user manually engaging (ME) the manually graspable mechanism, and the user applying a forwardly or downwardly directed force (FDF) on the manually graspable mechanism (30*h*) against resistance (R1, R1*a*) from the resistance mechanism.

Apparatus (10) for performing an arm extension exercise by a user (5) having a trunk (T1) having a longitudinal axis (LA), opposing anterior (AS) and posterior (PS) sides and arms (13) with elbows (13*e*) extending from the trunk (T1), the apparatus comprising:

a frame (12), a seat (16) having a seating surface (S), an elbow pad (19) having an engaging surface (ES), an input arm assembly (24) interconnected to a resistance mechanism (42) and a manually graspable mechanism (30*h*), the input arm assembly being pivotably mounted (AA, AAA) on the frame for back and forth travel along a generally upward (UW) to downward (DW) and forward (FW) to rearward (RW) direction, the input arm assembly (24) being adapted to reside in a start motionless position (SMP) relative to a selected arrangement of the seat (16) and elbow pad (19) that disposes the manually graspable mechanism (30*h*) in a start exercise position (SEP) that is disposed vertically above UW) the user's elbows (13*e*) when the user is seated on the seating surface (S) in an orientation where the anterior surface (AS) of the user's trunk (T1) is facing generally forwardly (FW), the seat (16) and elbow pad (18) being configured and arranged relative to the input arm assembly (24) to position the user in a user start position (USP) that enables the user to manually engage (ME) the manually graspable mechanism (30*h*) when the user is seated in an orientation where a posterior surface (PSE) of the user's elbow (13*e*) is engaged with the engaging surface (ES) of the elbow pad (19) and the anterior and posterior sides of the user's trunk are oriented in a generally forward (FW) to rearward (RW) direction, the input arm assembly comprising a first arm (30*r*) being rotatably pivotable around a first linear axis (AA) starting from the start exercise position (SEP) through a generally rearward to forward or upward to downward path of travel under resistance (R1) exerted by the resistance mechanism on application of forwardly or downwardly directed force (FDF) by the user (5) on the manually graspable mechanism (30*h*), the seat (16), elbow pad (19) and arm assembly (24) being arranged on the apparatus such that the first linear axis (AA) of pivoting of the arm (30*r*) is disposed rearwardly (RW) of the user's elbow (13*e*) when the user is seated on the seating surface (S) and the posterior surface (PSE) of the user's elbow (13*e*) is engaged with the engaging surface (ES).

The input arm assembly can comprise a second arm (30*f*) rotatably pivotable around a second linear axis (AAA) along a generally rearward to forward or upward to downward path of travel on application of forwardly or downwardly directed force (FDF) by the user (5) on the manually graspable mechanism (30*h*).

The second arm (30*f*) is preferably pivotable together with the first arm 30*r* around the first linear axis (AA) under resistance (R1, R1*a*) exerted by the resistance mechanism on application of generally forwardly downwardly force (FDF) by the user on the manually graspable mechanism (30*h*) starting from the start exercise position (SEP).

The manually graspable mechanism (30*h*) preferably comprises a handle link (30*l*) pivotably mounted to the second arm (30*f*) for separate rotation around a handle axis (Y).

The input arm assembly (24) is typically interconnected to the resistance mechanism (42) at a point of interconnection (30*de*) of the input arm assembly that is spaced a selected orthogonal distance (FOD) apart from the first linear axis (AA) selected to create a first selected torque resistance from the resistance mechanism against rearward (RW) to forward (FW) movement of the input arm assembly.

The input arm assembly (24) can be interconnected to the resistance mechanism (42) at a point of interconnection (30*de*) of the input arm assembly that is disposed rearwardly (RW) of the user's elbow (13*e*) when the user is seated on the seating surface (S) and the posterior surface (PSE) of the user's elbow (13*e*) is engaged with the engaging surface (ES).

The first linear axis (AA) and second linear axis (AAA) are typically disposed generally parallel relative to each other.

The first linear axis (AA) is preferably arranged at an angle (X) relative to horizontal (H) that is selected to direct the first arm (30*r*) to travel along a side to side (SS) or lateral path of travel laterally away from (LATO) a midline (M) of the user when the user exerts forwardly or downwardly (FDF) force on the first arm (30*r*) beginning from the start motionless position (SMP) and the user (5) is seated on the seat surface (S) with the user's anterior (AS) surface facing forwardly (FW).

A method of performing an arm extension exercise comprising:

a user being seated on the seat of the exercise apparatus described immediately above in a disposition where the user is seated on the seating surface, the anterior and posterior sides of the user's trunk are oriented generally in the forward to rearward direction, and the posterior surface of the user's elbow (PSE) is engaged with the engaging surface (ES) of the elbow pad (19), the user manually engaging (ME) the manually graspable mechanism, and the user applying a forwardly or downwardly directed force (FDF) on the manually graspable mechanism (30*h*) against resistance (R1, R1*a*) from the resistance mechanism.

In another aspect of the invention there is provided an apparatus (10) for performing a pull down exercise by a user (5) having a trunk (T1) having a longitudinal axis (LA), opposing anterior (AS) and posterior (PS) sides and an arm (13) with elbow (13*e*) extending from the trunk (T1), the apparatus comprising:

a frame (12), a seat (16) having a seating surface (S), an elbow pad (19) having an engaging surface (ES), an input arm assembly (24) interconnected to a resistance mechanism (42) and a manually graspable mechanism (30*h*), the input arm assembly being pivotably mounted on the frame for back and forth travel along a generally upward (UW) to downward (DW) and forward (FW) to rearward (RW) direction, the input arm assembly (24) being adapted to reside in a start motionless position (SMP) relative to a selected arrangement of the seat (16) and elbow pad (19) that disposes the manually graspable mechanism (30*h*) in a start exercise position (SEP) that is disposed vertically above the user's elbow (13*e*) when the user is seated on the seating surface (S) in an orientation where the anterior surface (AS) of the user's trunk (T1) is facing generally forwardly (FW), the seat (16) and elbow pad (19) being arranged relative to the input arm assembly (24) to position the user in a user start position (USP) that enables the user to manually engage (ME) the manually graspable mechanism (30*h*) when the user is seated in an orientation where a posterior surface (PSE) of the user's elbow (13*e*) is engaged with the engaging surface (ES) of the elbow pad (19) and the anterior and posterior sides of the user's trunk are oriented in a generally forward (FW) to rearward (RW) direction, the input arm assembly comprising a first arm (30*r*) being rotatably pivotable around a first linear axis (AA) starting from the start exercise position (SEP) through a generally rearward (RW) to forward (FW) or upward (UW) to downward (DW) path of travel under resistance (R1, R1*a*) exerted by the resistance mechanism on application of forwardly to rearwardly directed force (FDF) by the user (5) on the manually graspable mechanism (30*h*), the manually graspable mechanism (30*h*) being pivotably mounted to the arm assembly (24) and pivotable around a third linear axis (Y).

The seat (16), elbow pad (19) and arm assembly (24) are preferably arranged on the apparatus such that the first linear axis (AA) of pivoting of the arm (30*f*) is disposed rearwardly (RW) of the user's elbow (13*e*) when the user is seated on the seating surface (S) and the posterior surface (PSE) of the user's elbow (13*e*) is engaged with the engaging surface (ES).

The input arm assembly preferably comprises a second arm (30*f*) rotatably pivotable around the first linear axis (AA) and a second linear axis (AAA) along a generally rearward to forward or upward to downward path of travel on application of forwardly or downwardly directed force (FDF) by the user (5) on the manually graspable mechanism (30*h*).

The second arm (30*f*) is preferably pivotable around the second linear axis (AAA) on application of generally forwardly downwardly directed force (FDF) by the user on the manually graspable mechanism (30*h*) starting from the start exercise position (SEP).

The manually graspable mechanism can comprise a handle link 301 pivotably mounted to the second arm (30*f*) for separate rotation around the handle axis (Y).

The input arm assembly (24) can be interconnected to the resistance mechanism (42) at a point of interconnection (30*de*) of the input arm assembly that is spaced a first selected orthogonal distance (FOD) apart from the first linear axis (AA) selected to create a first selected torque resistance from the resistance mechanism against forward (FW) to rearward (RW) movement of the input arm assembly.

The first linear axis (AA) and second linear axis (AAA) can be disposed generally parallel relative to each other.

The first linear axis (AA) and the third linear axis (Z) can be disposed generally parallel to each other.

The second linear axis (AAA) and the third linear axis (Z) can be disposed generally parallel to each other.

Either the first linear axis (AA) or the second linear axis (AAA) is preferably arranged at an angle (X) relative to horizontal (H) that is selected to direct the first arm (30*r*) or the second arm (30*f*) to travel along a side to side (SS) or lateral path of travel laterally away from (LATO) a midline (M) of the user when the user exerts forwardly or downwardly (FDF) force on the first arm (30*r*) beginning from the start motionless position (SMP) and the user (5) is seated on the seat surface (S) with the user's anterior (AS) surface facing forwardly (FW).

In another aspect of the invention there is provided a method of performing an arm curl exercise comprising:

a user being seated on the seat of the exercise apparatus described immediately above in a disposition where the user is seated on the seating surface, the anterior and posterior sides of the user's trunk are oriented generally in the forward to rearward direction, and the posterior surface of the user's elbow is engaged with the engaging surface of the elbow pad, the user manually engaging (ME) the manually graspable mechanism, and the user applying a forwardly or downwardly directed force (FDF) on the manually graspable mechanism against resistance from the resistance mechanism.

BRIEF DESCRIPTION OF THE DRAWINGS

The above and further advantages of the invention may be better understood by referring to the following description in conjunction with the accompanying drawings in which.

DETAILED DESCRIPTION

Figure 1:
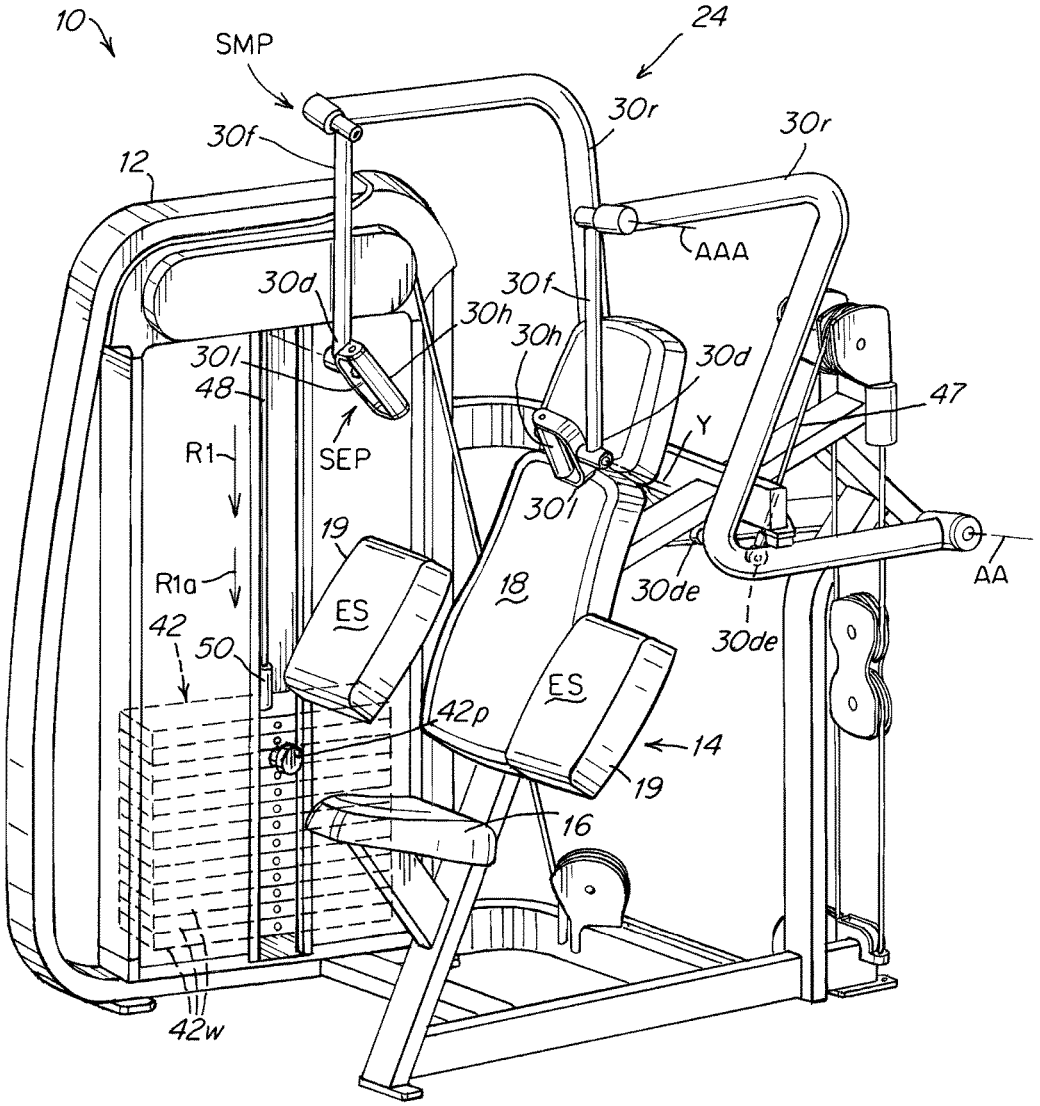
FIG. 1 is a front left side perspective view of an arm curl exercise apparatus according to the invention.
Figure 2:
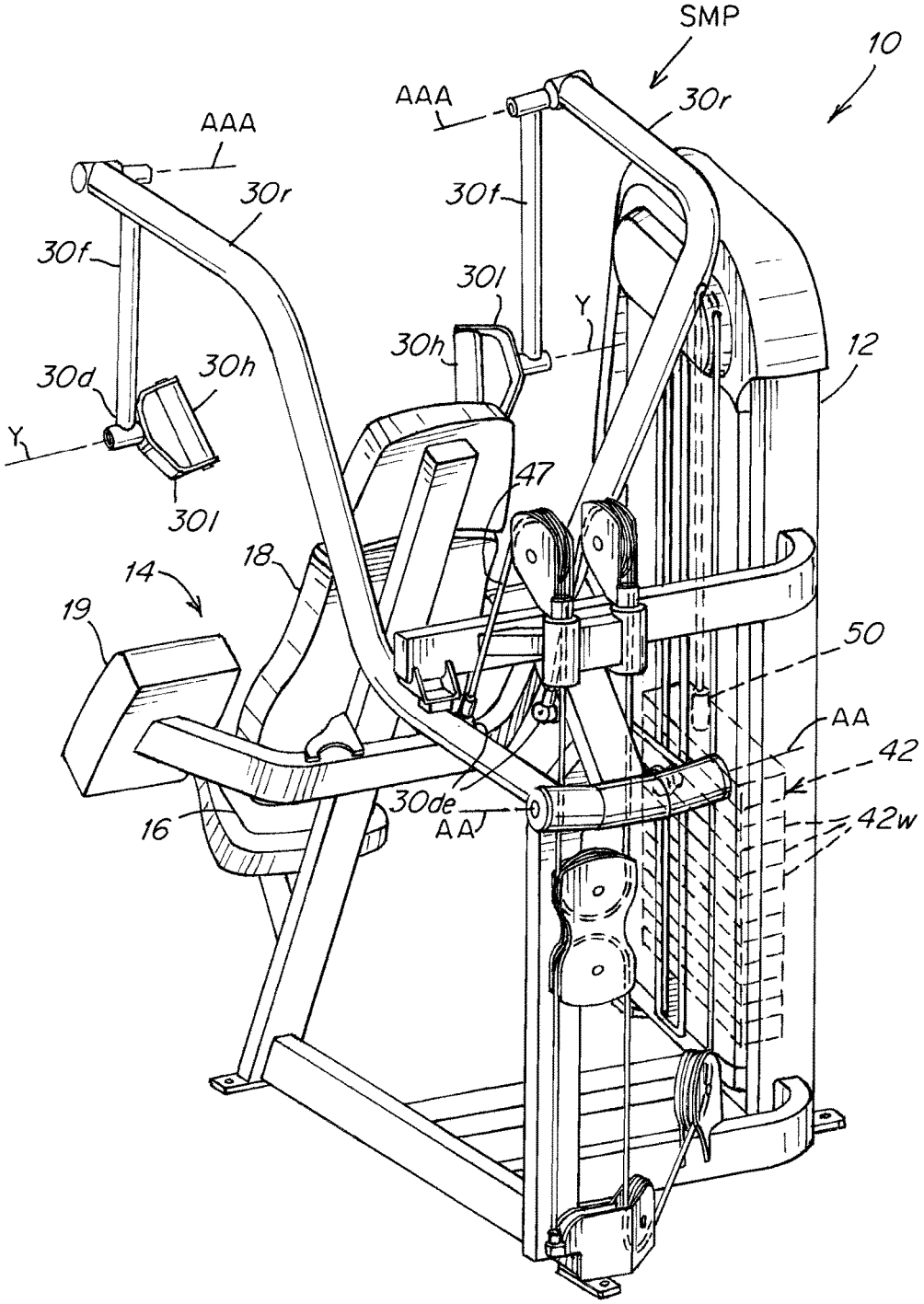
FIG. 2 is a rear left side perspective view of the FIG. 1 apparatus.
Figure 3:
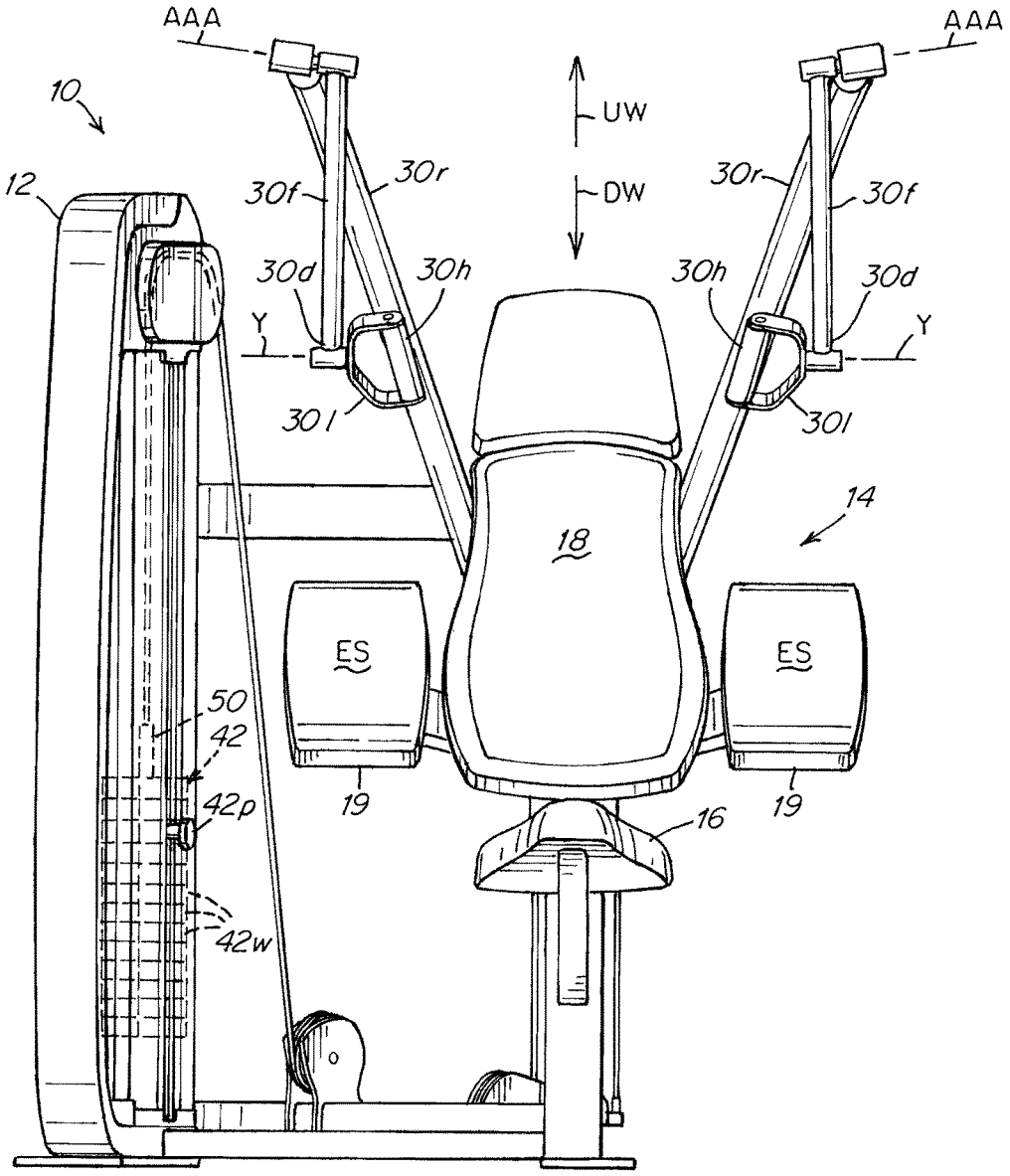
FIG. 3 is a front view of the FIG. 1 apparatus in a start motionless position.
Figure 4:
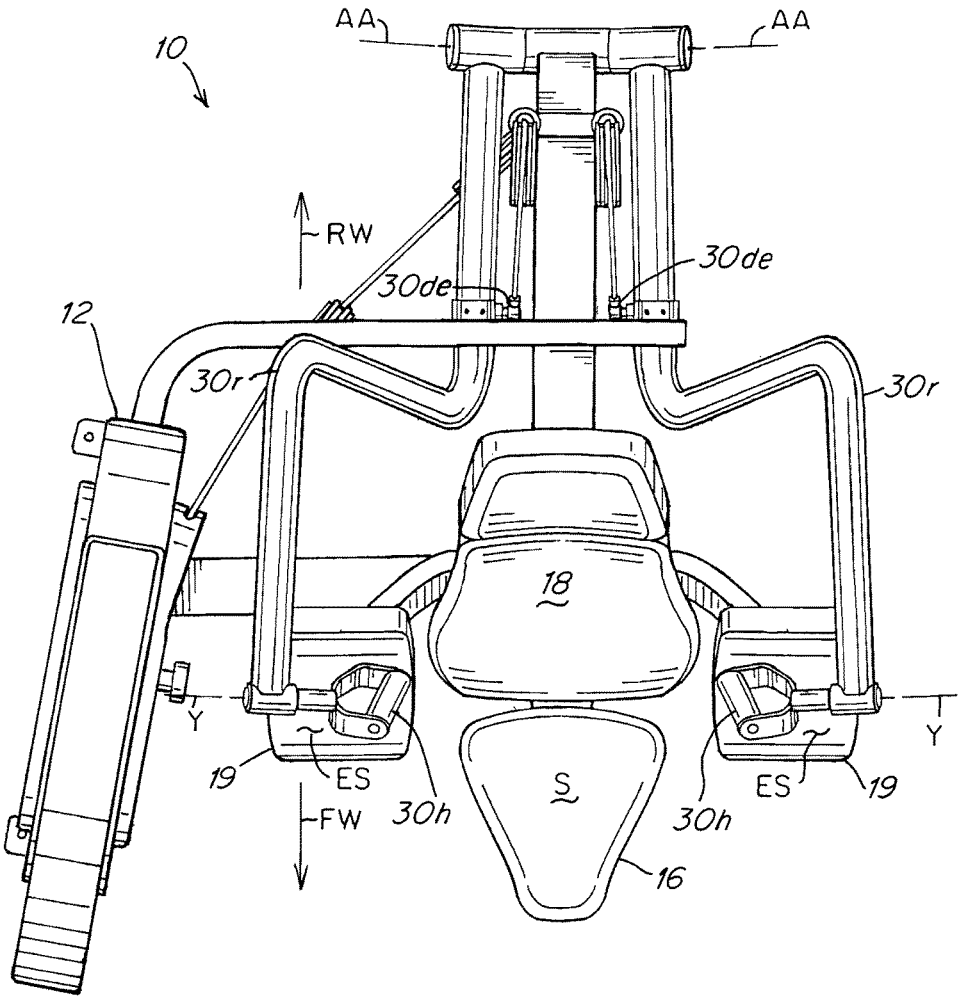
FIG. 4 is a top plan view of the FIG. 1 apparatus.
Figure 5A:
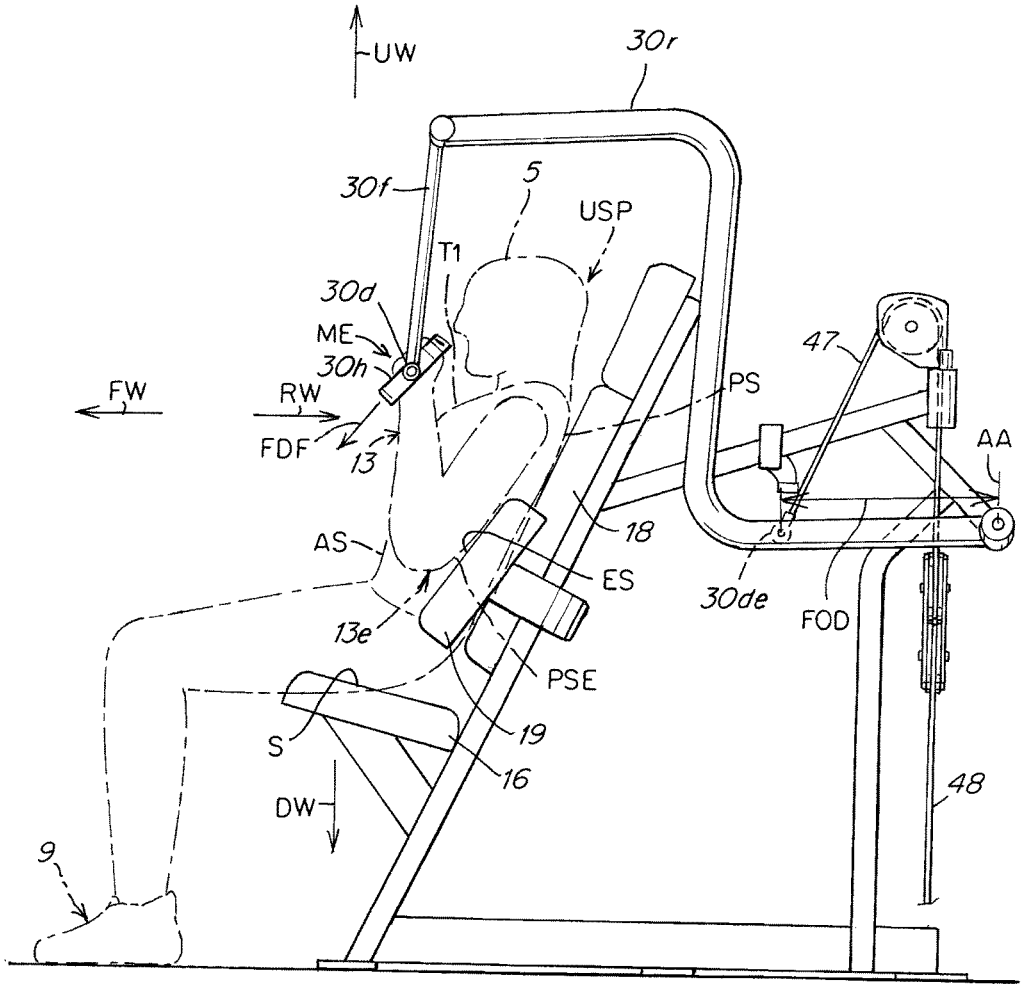
FIG. 5A is a schematic left side view of the FIG. 1 apparatus showing a user in a start exercise position.
Figure 5B:
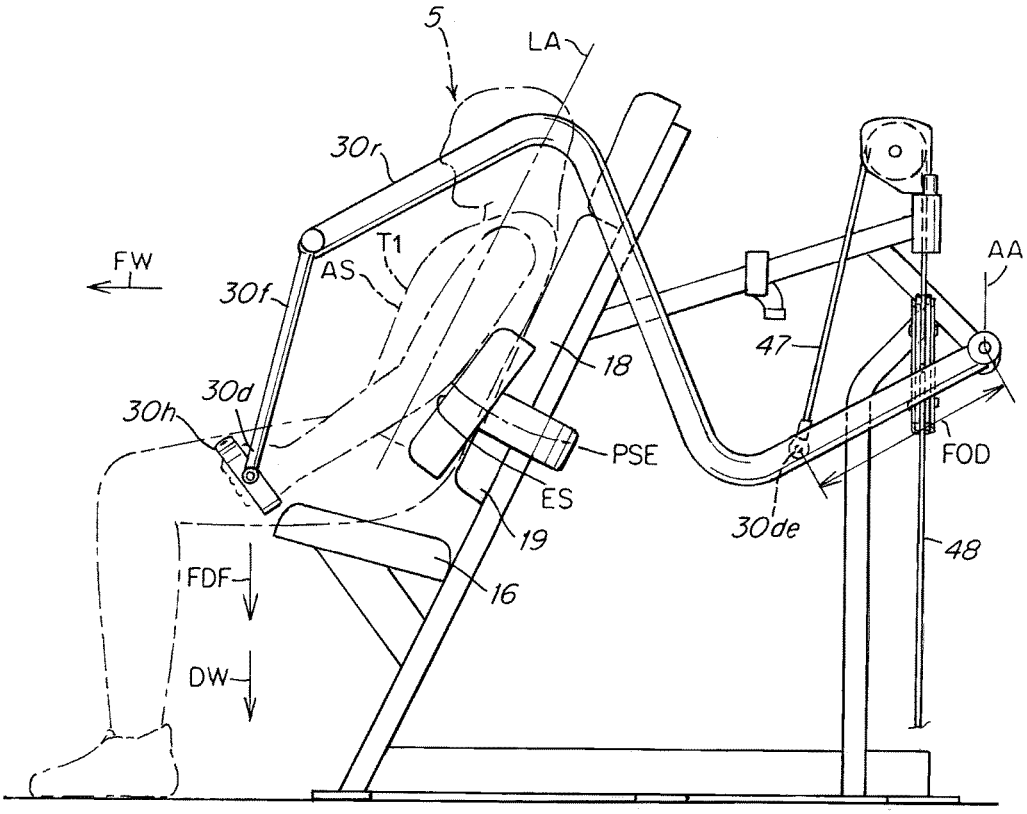
FIG. 5B is a view similar to FIG. 5A showing the user performing an arm extension exercise.
Figure 6A:
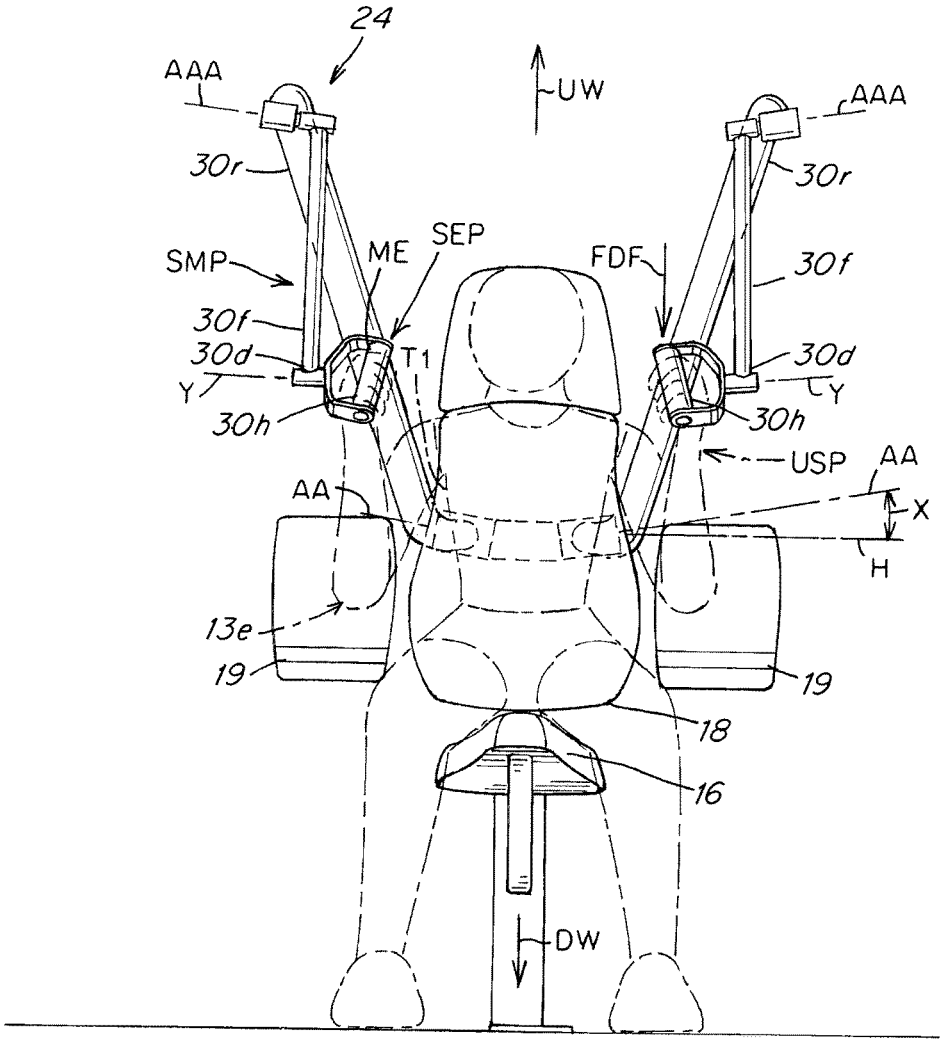
FIG. 6A is a schematic front view of the FIG. 1 apparatus showing a user in a start exercise position.
Figure 6B:
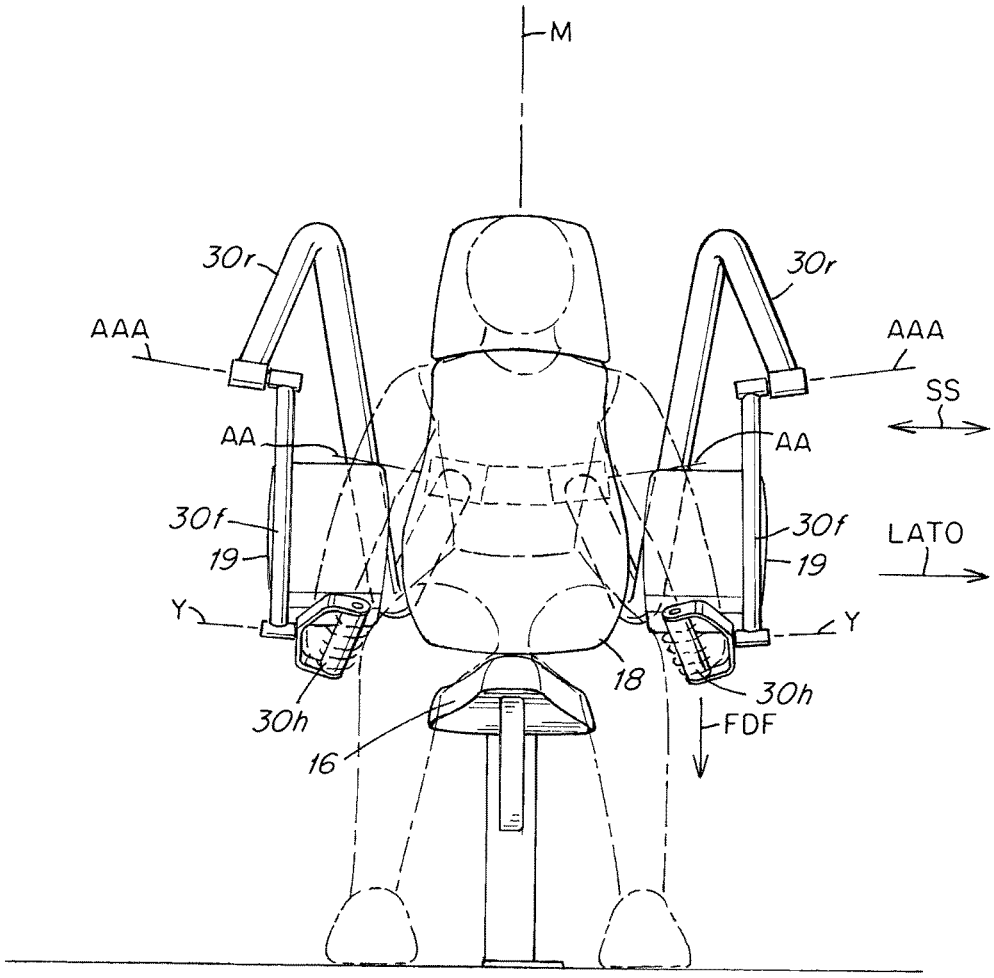
FIG. 6B is a schematic front view of the FIG. 1 apparatus showing a user performing an arm extension exercise.

In an exemplary embodiment, as shown in FIGS. 1, 2 an arm extension apparatus 10 of the present invention includes a support frame 12 on which a user support structure 14 is mounted. The user support structure 14 includes a seat surface 16, elbow pads 19 and a back rest 18. The seat 16 has a seating surface S and is mounted on the frame 12 disposed along a midline M between a pair of laterally disposed elbow pads 19 and laterally disposed input arm assemblies 24 which are comprised of a first arm 30*r* that is rotatably mounted to the frame for rotation around an axis AA. The axis AA is disposed rearwardly RW of the point of engagement of the posterior surface PSE of the user's elbow 13*e* when engaged with an elbow engaging surface ES of the pad 19. The input arm assembly 24 includes a second arm 20*f* that is rotatably mounted to a distal end of the first arm portion for rotation around a second axis AAA.

As shown, axes AA and AAA are approximately or generally parallel to each other, FIGS. 5A-6B. Axis AA is typically disposed at an acute angle X relative to horizontal H, FIGS. 6A, 6B, typically between about 5 degrees and about 75 degrees. Angle X is arranged such that the path of travel of the arms 30*r* and 30*f* when pulled forwardly and downwardly FDF by the user 5 beginning from a start motionless position SMP is generally laterally outwardly LATO away from a midline M of the user along a side to side SS or lateral path of travel.

The apparatus 10 includes handles 30*h* rotatably mounted for rotation around a third axis Y to enable the user's wrists to readily rotate the handles without resistance when pulling on the handles 30*h*.

The arms 30*f*, 30*r* are mounted to the frame 12 and arranged and adapted so as to be interconnected to a weight resistance (in this embodiment a weight stack 42). The weight stack 42 is selectively connectable to one end of a cable 48 by inserting a pin in one of a plurality of holes in a lifting post 50 that passes vertically through the plates 42*w*, as is well known in the art. For example, the weight stack 42 is formed by a stack of rectangular, brick-shaped plates 42*w*. Each plate 42*w* further has at least one horizontal channel or hole, wherein a pin 42*p* may be disposed to slidably engage any of a series of horizontal channels which are vertically oriented on the lifting post 50 in a spaced apart manner to match the vertical spacing of the stacked weight plates 42*w*. The pin 42*p* thereby engages a portion of the stack of weight plates 52, such that when vertical force FDF is applied to the lifting post 50, the selected stack of weight plates 42*w* is moved upwards to create a resistance R1, R1*a*. Typically, the weight stack 42 apparatus is oriented such that the further down the pin 42*p* is entered into the lifting post 50, the greater the number of plates 42*w* are engaged, thereby increasing the resistance R1, R1*a* of the machine 10.

In operation, the user 5 starts an exercise seated on the surface S with the user's anterior surface AS facing forwardly FW. At the start of the exercise the arms 30*r*, 30*f* and handles 30*h* are disposed in a start motionless position SMP and the handles 30*h* are disposed in the start exercise position SEP vertically above the point of engagement of the posterior surface PSE of the user's elbow with the engaging surface ES of the elbow pads 19. The user reaches upwardly UW and grabs the handles 30*h* or manually engages ME a handle 30*h* and exerts a forwardly or downwardly directed force FDF on the handle 30*h* which causes the user's elbows to travel downwardly and the posterior surface PSE of the user's elbow 13*e* to engage the engaging surface ES. The user then continues to exert additional forwardly or downwardly directed force FDF on the handles and the arms 30*r* rotates around axis AA with arm 30*f* rotating around both axes AA and AAA. As the arm 30*r* rotates around axis AA, cable 47 pulls under the user's force FDF to lift the selected number of weights 42*w* against their weight resistance R1, R1*a*.

The point of interconnection 30*de* of the cable 47 is to arm 30*r* such that the load or resistance R1, R1*a* is imposed on rotation TF of arm 30*r* and not on rotation of arm 30*f* around axis AAA.

In alternative embodiments, other mechanisms for providing resistance, such as friction fittings, springs, elastic bands, pneumatic or electromagnetic resistance, or an air resistance fan could be employed (either alone or in combination) and still practice the invention. Additionally, free weights could be operably engaged to the transmission 50 assembly to resist the movement.

The seat 16 is mounted on the frame in a position relative to the ground such that a user 5 can sit on the seat with the user's feet 9 touching the ground. The back rest 18 is mounted to the frame 12 relative to the seat 16 such that the user can engage the user's back PS against the back rest when seated S on the seat 16, A pair of elbow pads 19 are mounted to the frame laterally relative to the backrest 18 in an arrangement and adapted such that a user 5 seated S on the seat 16 can engage the posterior surface of the user's elbows PSE against the engaging surface ES of elbow pads 19 when seated. The input arm assembly 30 includes a pair of handles 30*h* mounted to a distal end 30*d* of the pivotable arm 30*f*, the arms 30*f*, 30*r* being mounted and adapted to dispose the grips or handles 30*h* in a starting or rest position SEP that is forwardly FW and above UW the point of engagement of the posterior surface PSE of the user's elbows 13*e* with the engaging surface ES of the elbow pads 19 when the user is properly seated on surface S in a position ready to manually engage ME the handles 30*h*.

The arm portion 30*r* is connected to the manually selectively adjustable weight resistance mechanism 42 via a cable and pulley assembly 47, 48, that is connected to the arm 30*r* at a connection point 30*de* that is disposed a preselected orthogonal distance FOD from the axis of rotation AA. The orthogonal distance FOD and point of connection 30*de* are selected to require a predetermined amount of torque force FDF necessary to lift the selected number of weights 42*w* via the cable 47, 48 and pulley interconnection to the stack 42. As shown, the cable assembly 47, 48 is interconnected downstream to the manifold pole 50 of the weight resistance mechanism. Forward FW and downward DW movement of arm 30*r* around axis AA, as well as forward and downward movement of arm 30*f* around axis AAA, results from a user's pushing or pulling FDF on a handle 30*h* beginning from the start motionless position SMP of the arm assembly 24. Such exertion of force FDF is resisted R1, R1*a* by the weight resistance mechanism 42 opposing rotation around axis AA by arm 30*r*. In the embodiments shown in FIGS.

1-7, when arm 30*r* moves forwardly FW or downwardly DW beginning from the start position SMP, the selected weight plates 42*w* will be lifted from the stack 42. When arm 30*r* moves rearwardly RW or upwardly UW, the lifted weights 42*w* will be lowered downwardly via the interconnection to cable W.

The grip or handle 30*h* is rotatably mounted on a distal end 30*d* of the forward arm 30*f* for free rotation around axis Y and is interconnected to the resistance mechanism 42 via interconnection to the arm 30*r*.

The seat 16, the back rest 18 and the elbow pads 19 are preferably fixedly mounted to the frame 12 and do not require adjustment by a user regardless of size, shape or configuration of the user. The arrangement and configuration of the seat 16 and elbow pads 19 are preferably selected such that a human being user of any size or configuration can seat themselves on the seating surface S with their anterior surface AS facing forwardly FW such that the posterior surface PSE of the user's elbow 13*e* will always be positioned such that the elbow surface PSE is enagageable against the engaging surface ES of the elbow pad 19 without vertical or horizontal adjustment of the seat 16.

The second arm portion 30*f* is pivotably mounted to a distal end of the first arm 30*r* for rotation around a second axis AAA that is generally parallel to axis AA. Arm 30*f* also can reciprocally travel or pivot both along a path that generally extends in a forward FW to rearward RW and upward UW to downward DW direction.

The seat, the back rest and the elbow pads are preferably fixedly mounted to the frame and do not require adjustment by a user regardless of size, shape or configuration of the user. The seat (16), seat surface (S), elbow pad (19) and engaging surface (ES) are configured and arranged on the frame such that a human being user of any human size or configuration, when seated on the seating surface (S) with the user's anterior surface (AS) facing forwardly (FW), can engage the posterior surface (PSE) of the user's elbow (13*e*) against the engaging surface (ES) of the elbow pad (19).

The first linear axis (AA) is preferably arranged at an angle (X) relative to horizontal (H) that is selected to direct the first arm (30*r*) to travel along a side to side (SS) or lateral path of travel laterally away from (LATO) a midline (M) of the user when the user exerts forwardly FW or downwardly DW directed force (FDF) on the first arm (30*r*) beginning from the start motionless position SMP and the user (5) is seated on the seat surface (S) with the user's anterior (AS) surface facing forwardly (FW). Acute angle X relative to horizontal H is preferably between about 20 degrees and about 75 degrees.

Figure 7:
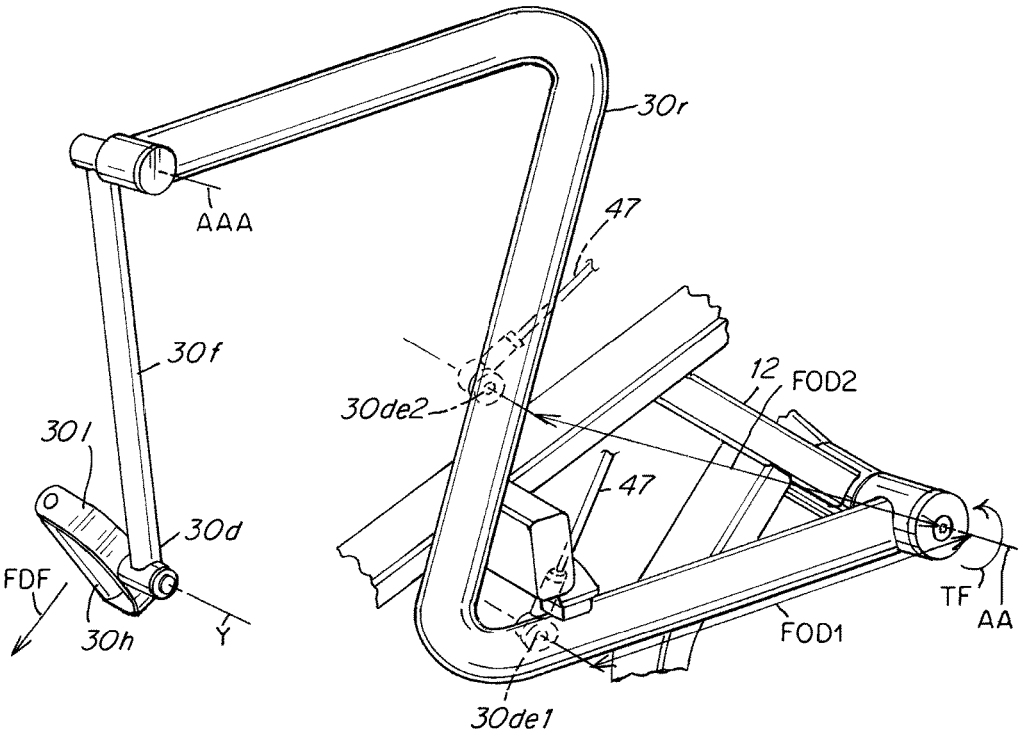
FIG. 7 is a left front fragmentary perspective view of an arm assembly of the FIG. 1 apparatus.

As shown in FIG. 7, the degree of torque force TF required to be exerted by the user 5 against the resistance F1, F1*a* of any given selected number of weights 42*w* will depend on the degree of the orthogonal distance between the point of interconnection 30*de* and the axis AA. As shown where the point of interconnection 30*de*2 is connected at an orthogonal distance that is larger distance FOD2 relative to a point 30*de*1 that is orthogonally spaced a lesser distance FOD1 from axis AA, the amount of torque force TF required will be concomitantly greater or lesser depending on the degree of the orthogonal distance FOD1 or FOD2.

What is claimed is:

1. Apparatus for performing an arm extension exercise by a user having a trunk having a longitudinal axis, opposing anterior and posterior sides and arms with elbows extending from the trunk, the apparatus comprising:

a frame, a seat having a seating surface, an elbow pad having an engaging surface, an input arm assembly interconnected to a resistance mechanism and a manually graspable mechanism, the input arm assembly being pivotably mounted on the frame for back and forth travel along a generally upward to downward or forward to rearward direction, the input arm assembly being adapted to reside in a start motionless position relative to a selected arrangement of the seat and elbow pad that disposes the manually graspable mechanism in a start exercise position that is disposed vertically above a point of engagement of a posterior surface of the user's elbows with the engaging surface, the seat and elbow pad being non-adjustably mounted to the frame in an arrangement that enables the user to manually engage the manually graspable mechanism in the start exercise position when seated on the seating surface with the posterior surface of the user's elbow engaged with the engaging surface of the elbow pad, the input arm assembly comprising a first arm being rotatably pivotable around a first linear axis starting from the start exercise position through a generally rearward to forward or upward to downward path of travel under resistance exerted by the resistance mechanism on application of forwardly or downwardly directed force by the user on the manually graspable mechanism, the input arm assembly comprising a second arm rotatably pivotable around a second linear axis along a generally rearward to forward or upward to downward path of travel on application of forwardly or downwardly directed force by the user on the manually graspable mechanism, the input arm assembly being arranged on the apparatus in an arrangement that enables the user being seated on the seating surface with the posterior surface of the user's elbow being engaged with the engaging surface.

2. The apparatus of claim 1 wherein the seat, elbow pad and arm assembly are arranged on the apparatus such that the first linear axis of pivoting of the arms is disposed rearwardly of the user's elbow when the user is seated on the seating surface and the posterior surface of the user's elbow is engaged with the engaging surface.

3. The apparatus of claim 1 wherein the second arm is pivotable together with the first arm around the first linear axis under resistance exerted by the resistance mechanism on application of generally forwardly downwardly force exerted by the user on the manually graspable mechanism starting from the start exercise position.

4. The apparatus of claim 1 wherein the manually graspable mechanism comprises a handle link pivotably mounted to the second arm for separate rotation around a third linear axis.

5. The apparatus of claim 4 wherein the first linear axis and the third linear axis are disposed generally parallel to each other.

6. The apparatus of claim 1 wherein the input arm assembly is interconnected to the resistance mechanism at a point of interconnection of the input arm assembly that is spaced a selected orthogonal distance apart from the first linear axis selected to create a first selected torque resistance from the resistance mechanism against rearward to forward movement of the input arm assembly.

7. The apparatus of claim 1 wherein the input arm assembly is interconnected to the resistance mechanism at a point of interconnection of the input arm assembly that is disposed rearwardly of the user's elbow when the user is seated on the seating surface and the posterior surface of the user's elbow is engaged with the engaging surface.

8. The apparatus of claim 1 wherein the first linear axis and second linear axis are disposed generally parallel relative to each other.

9. The apparatus of claim 1 wherein the first linear axis is arranged at an angle relative to horizontal that is selected to direct the first arm to travel along a side to side or lateral path of travel laterally away from a midline of the user when the user exerts forwardly or downwardly force on the first arm beginning from the start motionless position and the user is seated on the seat surface with the user's anterior surface facing forwardly.

10. A method of performing an arm extension exercise comprising:

a user being seated on the seat of the exercise apparatus of claim 1 in a disposition where the user is seated on the seating surface, the anterior and posterior sides of the user's trunk are oriented generally in the forward to rearward direction, and the posterior surface of the user's elbow is engaged with the engaging surface of the elbow pad, the user manually engaging the manually graspable mechanism, and the user applying a forwardly or downwardly directed force on the manually graspable mechanism against resistance from the resistance mechanism.

11. Apparatus for performing an arm extension exercise by a user having a trunk having a longitudinal axis, opposing anterior and posterior sides and arms with elbows extending from the trunk, the apparatus comprising:

a frame, a seat having a seating surface, an elbow pad having an engaging surface, arranged to engage a posterior surface of the user's elbow when the user is seated on the seat, an input arm assembly interconnected to a resistance mechanism and a manually graspable mechanism, the input arm assembly being pivotably mounted on the frame for back and forth travel along a generally upward to downward and forward to rearward direction, the input arm assembly being adapted to reside in a start motionless position relative to a selected arrangement of the seat and elbow pad that disposes the manually graspable mechanism in a start exercise position that is disposed vertically above UW the user's elbows when the user is seated on the seating surface in an orientation where the anterior surface of the user's trunk is facing generally forwardly, the seat and elbow pad being non-adjustably mounted to the frame in an arrangement that enables the user to manually engage the manually graspable mechanism in the start exercise position when seated on the seating surface with the posterior surface of the user's elbow engaged with the engaging surface of the elbow pad, the input arm assembly comprising a first arm being rotatably pivotable around a first linear axis starting from the start exercise position (SEP) through a generally rearward to forward or upward to downward path of travel under resistance exerted by the resistance mechanism on application of forwardly or downwardly directed force by the user on the manually graspable mechanism, the seat, elbow pad and arm assembly being arranged on the apparatus such that the first linear axis of pivoting of the arm is disposed rearwardly of the user's elbow in an arrangement that enables the user being seated on the seating surface and the posterior surface of the user's elbow engaging with the engaging surface.

12. The apparatus of claim 11 wherein the input arm assembly comprises a second arm rotatably pivotable around a second linear axis along a generally rearward to forward or upward to downward path of travel on application of forwardly or downwardly directed force by the user on the manually graspable mechanism.

13. The apparatus of claim 12 wherein the second arm is pivotable around the first linear axis together with the first arm under resistance exerted by the resistance mechanism on application of generally forwardly downwardly force by the user on the manually graspable mechanism starting from the start exercise position.

14. The apparatus of claim 12 wherein the first linear axis and second linear axis are disposed generally parallel relative to each other.

15. The apparatus of claim 11 wherein the manually graspable mechanism comprises a handle link pivotably mounted to the second arm for separate rotation around a handle axis.

16. The apparatus of claim 11 wherein the input arm assembly is interconnected to the resistance mechanism at a point of interconnection of the input arm assembly that is spaced a selected orthogonal distance apart from the first linear axis selected to create a first selected torque resistance from the resistance mechanism against rearward to forward movement of the input arm assembly.

17. The apparatus of claim 11 wherein the input arm assembly is interconnected to the resistance mechanism at a point of interconnection of the input arm assembly that is disposed rearwardly of the user's elbow when the user is seated on the seating surface and the posterior surface of the user's elbow is engaged with the engaging surface.

18. The apparatus of claim 11 wherein the first linear axis is arranged at an angle relative to horizontal that is selected to direct the first arm to travel along a side to side or lateral path of travel laterally away from a midline of the user when the user exerts forwardly or downwardly force on the first arm beginning from the start motionless position and the user is seated on the seat surface with the user's anterior surface facing forwardly.

19. A method of performing an arm extension exercise comprising:

a user being seated on the seat of the exercise apparatus of claim 11 in a disposition where the user is seated on the seating surface, the anterior and posterior sides of the user's trunk are oriented generally in the forward to rearward direction, and the posterior surface of the user's elbow is engaged with the engaging surface of the elbow pad, the user manually engaging the manually graspable mechanism, and the user applying a forwardly or downwardly directed force WD) on the manually graspable mechanism against resistance from the resistance mechanism.

* * * * *